United States Patent [19]

Johnson et al.

[11] 4,379,603

[45] Apr. 12, 1983

[54] DRAWER WITH REMOVABLE HANDLE

[75] Inventors: John R. Johnson, Arcadia; Robert Brydolf, Pasadena, both of Calif.

[73] Assignee: Acme General Corporation, San Dimas, Calif.

[21] Appl. No.: 218,529

[22] Filed: Dec. 22, 1980

[51] Int. Cl.[3] ..... A47B 95/02

[52] U.S. Cl. ..... 312/320; 312/239; 312/244; 16/110 R; 16/124

[58] Field of Search ..... 312/320, 244, 239; 16/124, 125, 111 R, 110 R

[56] References Cited

U.S. PATENT DOCUMENTS

| | | | |
|---|---|---|---|
| 2,771,627 | 11/1956 | Hammer | 16/124 |
| 2,793,386 | 5/1957 | Muhlhauser | 16/124 |
| 3,098,686 | 7/1963 | Benoit | 312/320 |
| 3,107,389 | 10/1963 | Engelbrecht | 312/320 |
| 3,120,984 | 2/1964 | Stohlberg | 312/320 |
| 3,170,743 | 2/1965 | Martiniak | 312/320 |
| 3,206,270 | 9/1965 | Vincens | 312/320 |
| 3,509,592 | 5/1970 | Schrock | 16/110 R |
| 4,040,695 | 8/1977 | Brann | 312/320 |
| 4,090,756 | 5/1978 | Frey et al. | 312/320 |

*Primary Examiner*—Victor N. Sakran

*Attorney, Agent, or Firm*—Christie, Parker & Hale

[57] ABSTRACT

A drawer handle can be removably mounted over a drawer front without fasteners or the like. The drawer front has a recessed region to facilitate opening the drawer, and the drawer handle can be snap-locked onto the drawer front to cover the recess and provide an optional means of opening the drawer. The drawer handle is of inverted U-shaped channel configuration including elongated front and rear flanges extending along a narrow base of the channel. The front and rear flanges can be spread apart to facilitate slipping the channel over the drawer front so the base of the channel rests on the upper edges of the drawer front, and the front and rear flanges overlie front and rear faces of the drawer front. The rear flange covers the recess in the drawer front, while the front flange is foreshortened relative to the rear flange and extends across the midpoint of the recess to provide a means for opening the drawer. A locking flange extending along the bottom edge of the rear flange projects into a slot adjacent a rear face of the drawer for snap-locking the handle into releasable engagement with the drawer front. Projecting ribs adjacent the rear face act as stops against lateral sliding movement of the handle. The front and rear flanges can be spread apart to release the locking flange from engagement with the slot so the channel can be removed from the drawer front.

10 Claims, 9 Drawing Figures

10
42
20
26
22
24
98
66
68
40
14
70
12
44

20
22
24
26
28
30
32
34
36
38
16
18
3
4

9
9

DRAWER WITH REMOVABLE HANDLE

BACKGROUND OF THE INVENTION

1. Field of the Invention

This invention relates to drawer systems, and more particularly to a drawer handle that removably attaches to a drawer front.

2. Description of the Prior Art

It often becomes necessary to provide additional storage space inside closets or the like. There are many reasonably inexpensive modular drawer systems that can be assembled by the purchaser and used to provide added storage space. Such drawer systems also can be used to provide additional storage space in mobile homes, travel trailers, motor homes, and the like. Many of these drawer systems have plastic drawers, or metal drawers with plastic drawer fronts. Some drawers can be made with drawer handles, while other drawers can have a drawer front with a recess in place of a drawer handle.

The present invention provides a drawer with a drawer handle that can be removably attached to a recessed portion of a drawer front so that drawer can optionally have a recessed front or a drawer handle. A drawer handle can be easily slipped onto the drawer front and locked in place, and easily released and removed from the drawer front. The drawer handle can add a rigidity to the drawer front, and it can be attached without requiring any special tools or fasteners.

SUMMARY OF THE INVENTION

Briefly, one embodiment of this invention provides a removable drawer handle for slipping over the top edge of a drawer front having front and rear faces and a slot adjacent the rear face. The drawer handle has a cross-section of generally U-shaped channel configuration including elongated front and rear flanges extending along a narrow base of the channel. The front and rear flanges are bendable away from each other so the base of the channel can slip over the top edge of the drawer front with the front and rear flanges of the channel overlying the front and rear faces of the drawer front. A lower locking flange extending along a lower portion of the rear flange of the channel interlocks with a slot adjacent the rear face of the drawer front for removably locking the drawer handle in a fixed position on the drawer front. The rear flange of the channel can be bent away from the front flange to remove the locking flange from the slot for removing the drawer handle from the drawer front.

DRAWINGS

DETAILED DESCRIPTION

Figure 1:
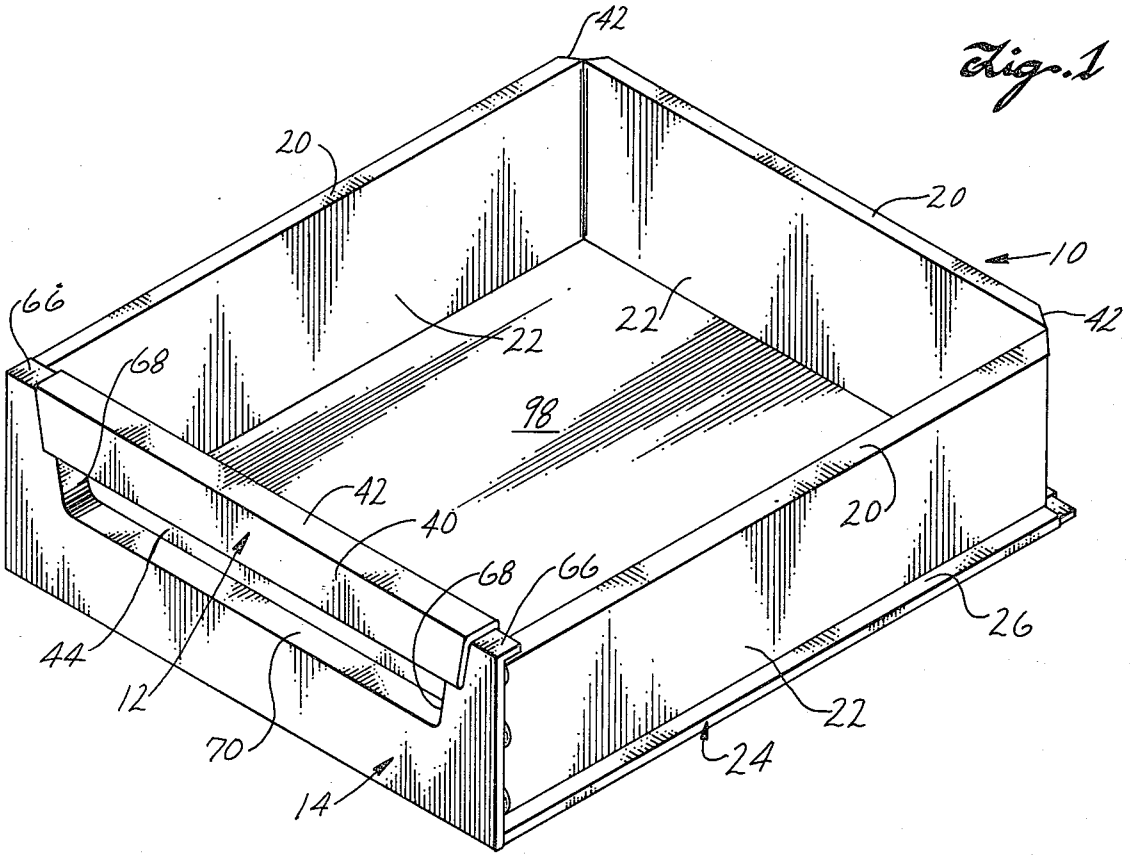
FIG. 1 is a perspective view showing a drawer and a drawer handle according to principles of this invention.

FIG. 1 is a perspective view illustrating a drawer 10 with a removable handle 12 secured to a drawer front 14. A plurality of such drawers can be slidably mounted in a drawer mounting frame similar to that described in application Ser. No. 218,070, filed 12-19-80, titled "KNOCK-DOWN DRAWER/SHELF ASSEMBLY", by Jerry L. Bohannan and Kenneth K. Kellems, which is assigned to the assignee of this application and incorporated herein by this reference.

Figures 2, 3, 4:
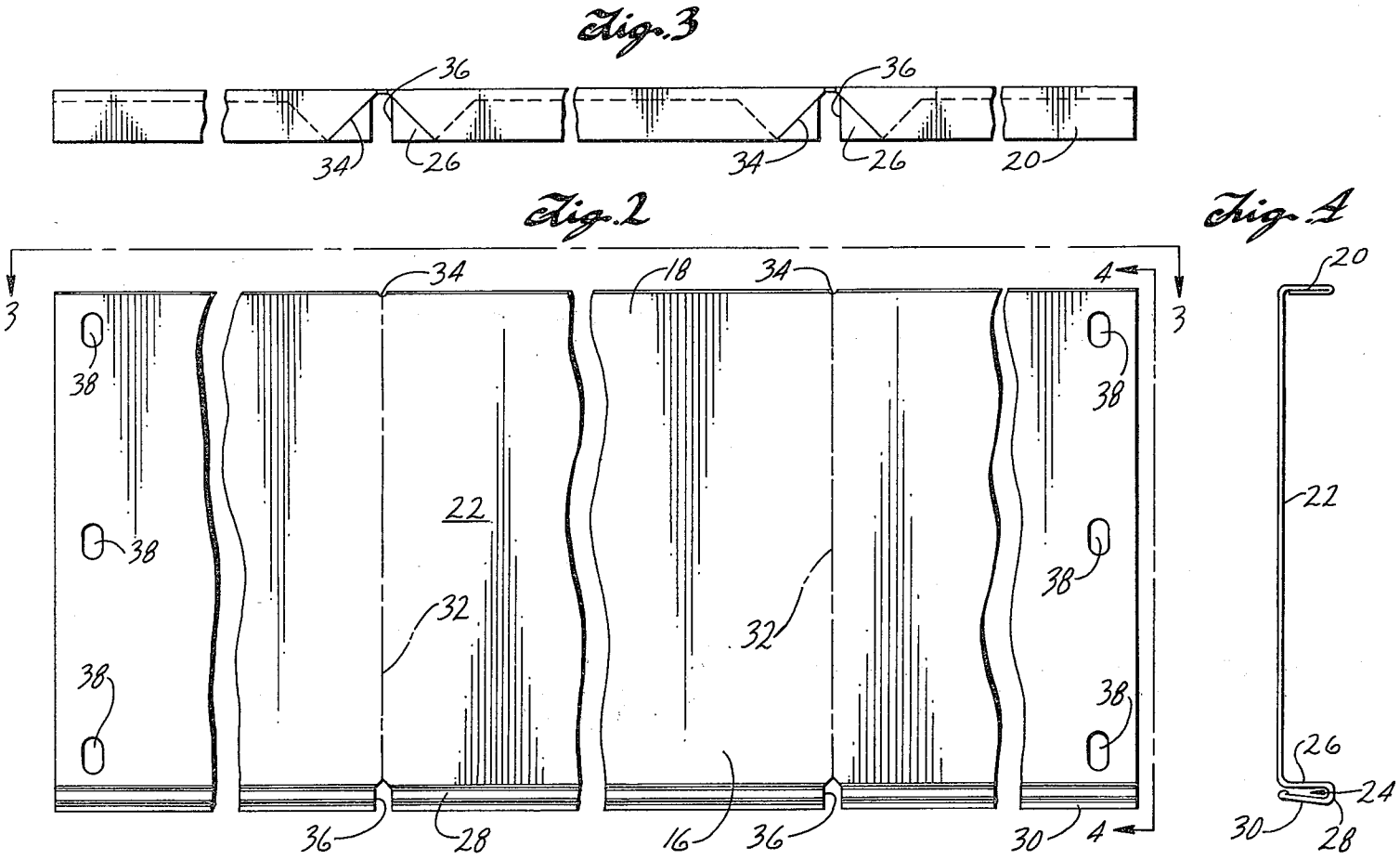
FIG. 2 is a fragmentary side elevation view showing a drawer side wall in flat form.
FIG. 3 is a fragmentary top elevation view taken on line 3—3 of FIG. 2.
FIG. 4 is an end elevation view taken on line 4—4 of FIG. 2.

The drawer 10 can be manufactured in knock-down form and assembled into the completed form illustrated in FIG. 1. FIGS. 2 through 4 illustrate components of the knock-down form of the drawer assembly which includes a drawer side wall 16 formed as a roll-formed flat metal piece 18 having a short upper flange 20 of double wall thickness bent at a right angle to a web 22 which comprises the principal portion of the drawer side wall. The bottom of the web is bent to form a generally U-shaped bottom channel 24 projecting from the same side of the web as the upper flange of the drawer side wall. The bottom channel is formed by bending the metal piece at a right angle to the web to form an upper flange 26 of the channel. The metal piece is then bent downwardly at a right angle to form a short bight portion 28 of the lower channel, and the metal piece is then bent back to form a lower flange 30 of the bottom channel. The lower flange of the bottom channel is tapered upwardly toward the opening of the channel, and the outer end portion of the metal piece is doubled back on itself so the outer edge of the lower flange is of double wall thickness.

To form the drawer side wall the user bends the flat metal piece along two vertical axes 32 into a U-shaped form providing a rear wall and opposite side walls of the drawer. The right angle bends formed along the axes 32 form the rear corners of the drawer side wall. A pair of longitudinally spaced apart V-shaped notches 34 are formed in the upper flange 20 of the drawer side wall in line with the axes 32. Similarly, a pair of longitudinally spaced apart narrow rectangular notches 36 are formed in the bottom channel 24 of the drawer side wall also in line with the axes 32. These notches facilitate bending the drawer side wall along the two vertical axes 32.

Vertically spaced apart upper, intermediate and lower elongated holes 38 extend through the web portion of the drawer side wall immediately inboard the front edge of each side wall.

In one embodiment, the drawer side wall is roll-formed from a 0.017 inch thick metal piece approximately 48.6 inches long. The drawer side wall has a depth of about 4.82 inches, a maximum height of 4.98 inches, including the bottom channel 24 with the width of the upper flange 20 and the lower channel 24 being approximately 0.50 inch.

Figure 6:
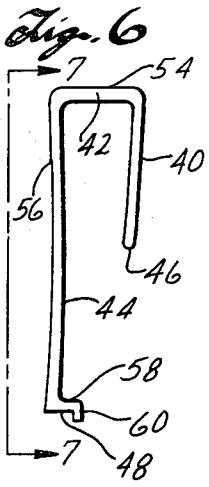
FIG. 6 is an end elevation view taken on line 6—6 of FIG. 5.
Figure 5:
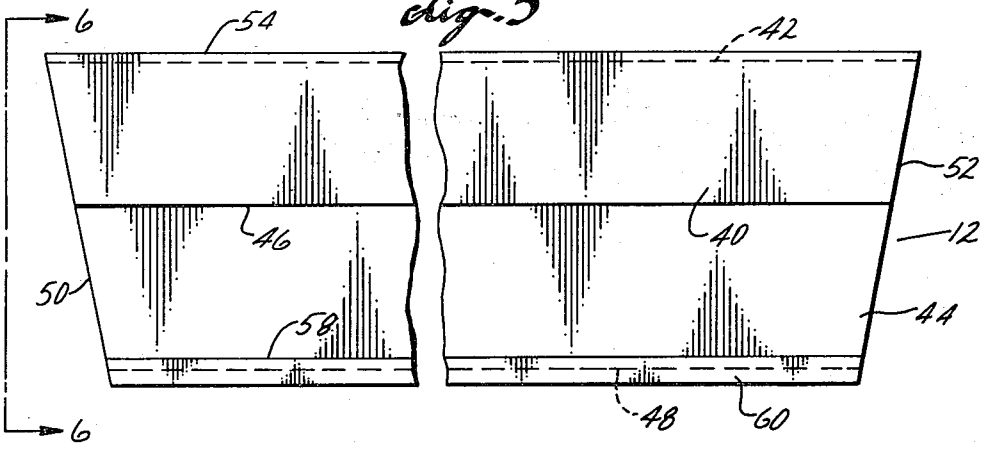
FIG. 5 is a front elevation view showing a drawer handle.
Figure 7:
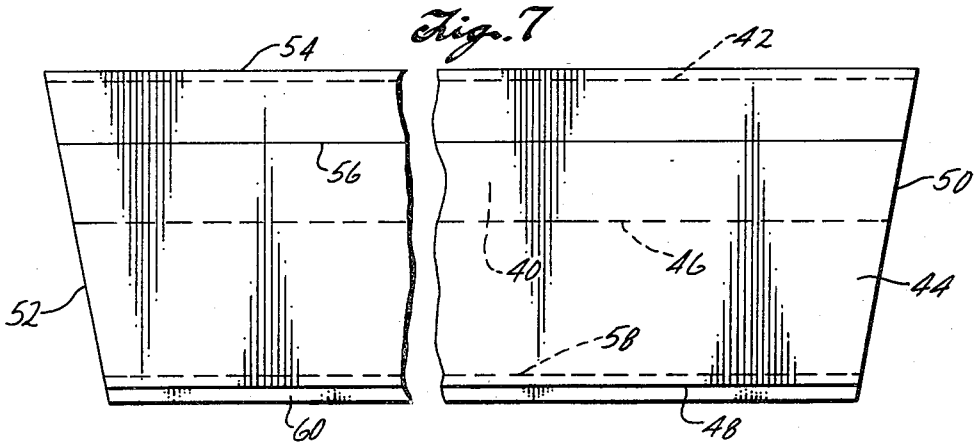
FIG. 7 is a rear elevation view taken on line 7—7 of FIG. 6.

FIGS. 5 through 7 illustrate the detailed construction of the drawer handle 12 which attaches to the drawer front 14. The drawer handle is an elongated piece of generally inverted U-shaped channel configuration. The channel is long and narrow and includes a thin, flat front flange 40 extending along one edge and at substantially a right angle to a narrow, thin, flat elongated base portion 42 of the channel. The base portion of the channel is of uniform width from end to end. A thin, flat rear flange 44 extends along the edge of the base opposite the front flange, and the rear flange projects away from the base at substantially a right angle and in the same direction as the front flange, forming the U of the channel. The front and rear flanges extend substantially parallel to one another, as illustrated best in FIG. 6; and the rear flange is wider than the front flange. In the illustrated embodiment, the rear flange is about twice as wide as the front flange. Thus, the front flange has a bottom edge 46 which is spaced from and located closer to the base of the channel than a bottom edge 48 of the rear flange. As shown best in FIG. 5, the bottom edges of the front and rear flanges extend parallel to one another; and opposite left and right edges 50, 52 of the handle converge downwardly toward one another at a slight angle, approximately 10 degrees per side, so that the bottom edge of the rear flange is slightly shorter than a top edge 54 of the channel. The rear flange has a shallow ridge 56 extending across an upper portion of it, making the upper portion of the rear flange slightly greater in thickness than the lower portion of the rear flange below the ridge.

A short locking flange 58 extends along the bottom edge of the rear flange. The locking flange projects away from the rear flange at substantially a right angle and extends in the same direction from the plane of the rear flange as the base portion of the channel. The locking flange and the base portion of the channel are approximately parallel to one another, and the locking flange is approximately half the width of the base portion of the channel. The end of the locking flange spaced from the rear flange has a bottom lip 60 which projects downwardly at substantially a right angle from the locking flange in a direction away from the base of the channel. The bottom lip has a narrow width shorter than the width of the locking flange; and in one embodiment, the width of the bottom lip is about the same as the wall thickness of the handle.

In one embodiment, the drawer handle is made of rigid polyvinyl chloride or ABS; the front flange 40 has a width of about 1.5 inches and a wall thickness of about 0.1 inch; and the rear flange 44 has a width of about 3.13 inches, with a wall thickness above the ridge 56 of about 0.1 inch, and a wall thickness below the ridge of about 0.09 inch. The base of the channel has a wall thickness of about 0.1 inch, and an inside width of about 0.77 inch; and the spacing between the bottom edge 46 of the front flange and the adjacent rear flange is about 0.70 inch. This provides a slight convergence of the two flanges of the channel toward each other so that the two flanges can be held in tension when slipped over the drawer front, as described in more detail below. The locking flange has a width of about 0.31 inch, the wall thickness of the locking flange is about 0.80 inch, the bottom lip has a width of about 0.17 inch, and the wall thickness of the lip is about 0.10 inch.

Figures 8, 9:
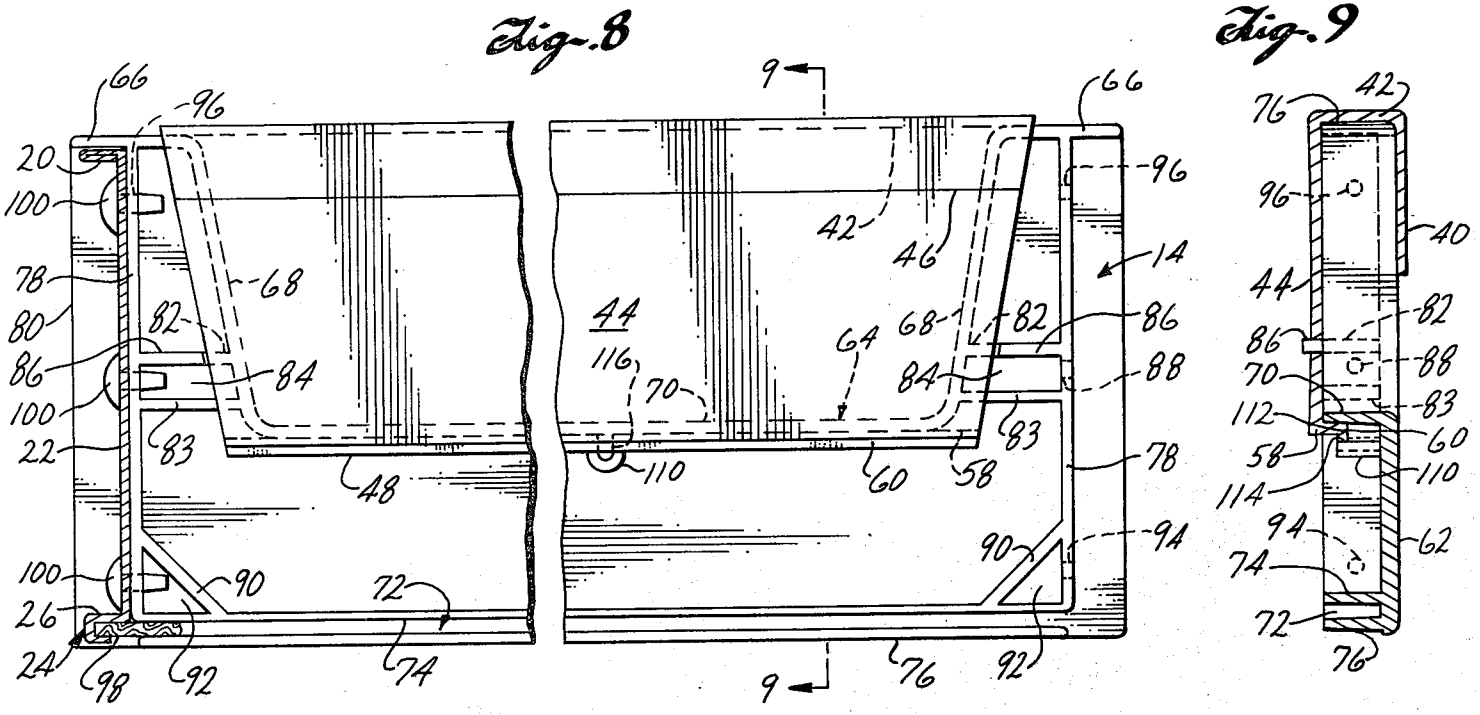
FIG. 8 is a fragmentary, rear elevation view showing the back side of the drawer handle attached to the drawer front.
FIG. 9 is an end elevation view taken on line 9—9 of FIG. 8.

FIGS. 8 and 9 illustrate the drawer front 14 which is preferably molded from a hard plastic material such as high impact polystyrene. The drawer front has a front panel with a flat front face 62, and a generally U-shaped recess 64 that extends along an upper intermediate portion of the drawer front. The top edge of the drawer front is bordered by a continuous rearwardly extending flange having generally horizontal upper outer portions 66, downwardly and inwardly extending side portions 68, and a generally horizontal long central portion 70 parallel to the top edge of the drawer front. A narrow, rearwardly extending channel 72 is formed between upper and lower horizontal flanges 74 and 76 extending along the lower portion of the drawer front. Long vertical flanges 78 spaced inwardly a short distance from vertical outer edges 80 of the drawer front extend from the upper, outer flanges 66 at the top of the drawer front downwardly to the upper flange 76 of the channel 72 at the bottom of the drawer front.

A pair of vertically spaced apart upper and lower horizontal ribs 82, 83 extend between each vertical flange 78 and the diagonal side portion 68 of the upper flange to form a pair of generally rectangular enclosed regions 84 inboard the vertical flanges. The upper flanges have protruding end portions 86 that project outwardly beyond the plane of the rear face of the drawer front, as shown best in FIG. 9. Separate holes 88 extend through the vertical flanges 84 into the enclosed spaces 84. A pair of diagonal ribs 90 extend between each vertical flange and the upper flange 74 of the lower channel 72 to form a pair of enclosed triangular spaces 92 above the outer ends of the lower channel. Separate holes 94 extend through the vertical flanges into the triangular enclosed spaced 92. Another pair of holes 96 extend through the vertical flanges immediately below the upper outer portions 66 of the upper flanges.

The drawer front is attached to the front ends of the drawer side wall 16, once the drawer side wall is bent from its flat form illustrated in FIGS. 2 through 4 into the U-shape best illustrated in FIG. 1. When the drawer side wall is in its U-shape form, the lower channel 24 faces inwardly along the bottoms of the rear wall and opposite side walls of the drawer. A rectangular drawer bottom panel 98 (see FIGS. 1 and 8) is slipped into the lower channels formed at the bottom of the drawer rear wall and side walls, so that a rear edge and opposite side edges of the drawer bottom panel make a tight friction fit in the lower channels.

The drawer front is then placed over the front edges of the drawer side wall 16 and the drawer bottom panel. As best shown at the left side of FIG. 8, the front portion of the drawer bottom panel 98 is slipped into the lower channel 72 that extends across the bottom of the drawer front. The vertical webs 22 on the drawer side walls overlie the outer faces of the vertical flanges 78 inside the drawer front, and the upper flanges 20 of the drawer side walls fit under the upper flanged portions 66 of the drawer front. When the front portions of the drawer side walls and the bottom panel are inserted into the drawer front, the three elongated holes 38 in the drawer side walls are aligned with the holes 96, 88, 94 in the vertical flanges 78 of the drawer front. Fasteners 100 are then driven into the aligned holes for securing the drawer front to the opposite side portions of the drawer side wall. In one embodiment, the fasteners 100 can be a "canoe clip", a fastener made of a hard plastic material with a generally canoe-shaped shank that is narrower at its ends, and wider in its middle, with a small canoe-shaped depression in the shank. The canoe clips make a tight friction fit in the aligned holes to securely hold the drawer front on the drawer side wall. As shown best in FIG. 8, each shank portion of the lower clips extends into one of the enclosed spaces 92, and each shank portion of the clips at the middle of the drawer extends into one of the enclosed spaces 84 so that these fasteners are shielded from the inside of the drawer. This avoids snagging contents in the drawer on the ends of the fasteners.

The bottom flanges 24 of the drawer side walls 22 project outwardly in a manner akin to a pair of rails extending along the lower side edge of the drawer. These side rails can slide lengthwise in channels of drawer guide members in a frame or the like for holding a number of drawers.

The drawer handle 12 can be attached over the recess in the drawer front 14 so the rear flange 44 covers the entire opening of the recess, while the front flange and the open channel between the front and rear flanges provide a handle for use in opening the drawer.

FIGS. 8 and 9 best show the means of attaching the drawer handle to the drawer front. Generally, the channel formed by the handle is slipped down over the top of the drawer front until the locking flange on the bottom of the rear flange snap locks into a slot adjacent the rear face of the drawer front. More specifically, the channel is positioned in the inverted U position shown in FIG. 9, and the front and rear flanges are spread apart and slipped around the front and rear faces of the drawer front. The channel is then pushed down over the drawer front until the inside wall of the base portion of the channel contacts the upper flanges 66 on the opposite sides of the drawer front. As shown best in FIG. 9, the inside of the front flange overlies the front face of the drawer front structure and the inside of the rear flange is adjacent the rear face of the drawer front structure. In sliding the channel down over the drawer front, the bottom lip 60 rides on the diagonal side flanges 68 along opposite sides of the recess. In this position the rear flange is bent away from the plane of the rear face of the drawer front structure. Continued downward sliding movement of the channel eventually causes the bottom lip to pass over the lower flange 70 at the bottom of the recess 64 in the drawer front. Continued further sliding movement then causes the locking flange 58 and the lip 60 to ride over the lower flange 70 and snap into engagement with a slot formed adjacent the rear face of the drawer front structure. The slot is formed by a post 110 projecting from the rear face of the front panel of the drawer front below the lower flange 70 at the bottom of the recess in the drawer front. A recess 112 is formed in the upper portion of the post immediately beneath the lower flange of the recess 64 in the drawer front. This forms an outwardly facing, generally U-shaped slot between the underside of the lower flange and a projecting top edge 114 of the post. A narrow flange 116 above the post forms the rear face of the slot under the flange. The locking flange 58 at the bottom of the rear flange 44 snaps into the slot and the bottom of the lower lip contacts the edge 114 of the post. The upper face of the locking flange bears against the bottom edge of the lower flange 70 at the bottom of the recess. The locking flange snaps into locking engagement with the slot because once the lip passes over the lower flange, the tension in the bent rear flange is released and the flange snaps into its normal planar position. This locking engagement between the bottom edge of the rear flange (the locking flange and the lower lip) and the slot holds the handle in its fixed position and acts as a stop against any upward movement of the handle away from its locked position. The base of the channel rests on the top edge of the drawer front, preventing any downward movement. In its locked position, the front and rear flanges bear against the front and rear faces of the drawer front structure and are held parallel to one another, i.e., under a slight amount of tension, owing to the normal convergence of the front and rear flanges.

As the bottom edge of the rear flange snap locks into engagement with the slot, the side edges of the channel snap into a fixed position between the projecting portions 86 of the ribs 82. The projecting portions of the ribs project away from the rear face of the drawer front structure, and these projecting portions are located immediately adjacent to the opposite side edges of the rear flange. The projecting portions of the ribs thus act as stops against lateral movement of the channel, once the channel is snap locked into its fixed position. FIG. 8 best illustrates the projecting portions of the ribs adjacent the side edges of the rear flange of the channel.

The handle can be simply removed from the drawer front by gripping the rear flange of the handle and bending it away from the front flange. Since the front flange bears against the front face of the drawer front structure, it provides a constraint to facilitate bending the rear flange away from the front flange. By bending the rear flange away from the rear face of the drawer front structure, the locking flange and bottom lip of the channel can be removed from the slot and the rear flange can be bent away from the rear face of the drawer front sufficiently so that the channel can be slipped upwardly away from the top of the drawer front.

Thus, the invention provides a drawer handle that can be easily secured to a drawer front so the handle can cover a recess in the drawer front. No special tools or fasteners are required to attach the handle, since the handle attaches only by frictional interlocking with the rear face of the drawer front, which also allows the handle to be easily removed from the drawer front.

What is claimed is:

1. A drawer assembly comprising:

a drawer front structure having a front face and a rear face; a pair of spaced apart upper edges above the front and rear faces; and a recess formed in the front and rear faces between the upper edges of the drawer front structure, the recess having a lower edge extending across the drawer front structure below said upper edges;

a slot formed adjacent the rear face of the drawer front structure below the lower edge of the recess; and a drawer handle for being removably attached to the drawer front structure, the drawer handle having a cross-section of generally inverted U-shaped channel configuration including spaced apart front and rear flanges on opposite sides of a base portion of the channel; and a locking flange on a lower portion of the rear flange projecting toward the front flange of the channel, the locking flange being shaped to extend into the slot adjacent the rear face of the drawer front structure for releasably interlocking the locking flange in the slot to hold the rear flange in a fixed position with respect to the drawer front structure when the base portion of the channel rests on the upper edges of the drawer front structure for maintaining the front flange in a fixed position adjacent the front face of the drawer front structure, while the rear flange extends adjacent the rear face of the drawer front structure and covers at least a portion of the recess in the drawer front structure.

2. Apparatus according to claim 1 in which the front flange is shorter than the rear flange so the front flange covers only a portion of the recess, while the rear flange covers substantially the entire recess.

3. Apparatus according to claim 1 in which the front and rear flanges are bendable away from one another to facilitate slipping the channel around the front and rear faces of the drawer front structure and to facilitate bending the rear flange away from the rear face of the drawer front structure to remove the locking flange from the slot.

4. Apparatus according to claim 1 including a pair of laterally spaced apart side flanges projecting away from the rear face of the drawer front structure, the spacing between the side flanges being such that the side flanges are located adjacent opposite side edges of the rear flange of the channel when the channel is in said fixed position on the drawer front structure, for acting as a stop against lateral movement of the channel from said fixed position.

5. Apparatus according to claim 1 including an elongated lower flange extending along the bottom of the recess and projecting away from the front face and toward the rear face of the drawer front structure; in which the slot adjacent the rear face of the drawer front is located under the lower flange of the recess; and in which the locking flange at the bottom of the rear flange of the channel extends under the bottom flange and into the slot.

6. Apparatus according to claim 1 in which the locking flange has a lower lip projecting away from the plane of the locking flange generally in the direction away from the base portion of the channel, the lip extending into the slot when the locking flange extends under the bottom flange and into the slot.

7. A drawer assembly comprising:

a drawer front structure having a front face and a rear face; a pair of laterally spaced apart upper edges on opposite sides of a recess formed in the front and rear faces, the recess having a lower edge extending across the front and rear faces below the upper edges; upper flanges adjacent the upper edges of the drawer front extending away from the front face to the rear face of the drawer front structure; and a rear flange adjacent the lower edge of the recess extending away from the front face to the rear face of the drawer front;

a slot formed adjacent the rear face below said lower flange; and a drawer handle for being removably attached to the drawer front structure, the drawer handle having a cross-section of generally inverted U-shaped channel configuration including spacing apart front and rear flanges on opposite sides of a base portion of the channel, and a locking flange on a lower portion of the rear flange, the flanges of the channel being bendable for spreading the flanges apart to fit the front and rear flanges around the front and rear faces of the drawer front structure and to slide the channel downwardly to a fixed position in which the locking element snap locks into engagement with the slot, in which the base portion rests on the upper flanges while the locking flange fits under the lower flange adjacent the recess.

8. Apparatus according to claim 7 in which the rear flange of the channel overlies the rear face of the drawer front structure.

9. Apparatus according to claim 7 in which the front flange is shorter than the rear flange so the front flange covers only an upper portion of the recess, while the rear flange covers a greater portion of the recess when the handle is in the fixed position on the drawer front structure.

10. Apparatus according to claim 7 including a pair of laterally spaced apart side flanges projecting away from the rear face of the drawer front structure, the spacing between the side flanges being such that the side flanges are located adjacent opposite side edges of the rear flange of the channel when the channel is in said fixed position on the drawer front structure.

* * * * *